United States Patent [19]

Williams

[11] Patent Number: 5,058,761

[45] Date of Patent: Oct. 22, 1991

[54] RECLOSABLE PACKAGE AND A BASE PORTION OF THE PACKAGE

[75] Inventor: Roger S. Williams, Calhoun, Ga.

[73] Assignee: Bryan Foods, Inc., West Point, Miss.

[21] Appl. No.: 580,137

[22] Filed: Sep. 10, 1990

[51] Int. Cl.[5] ..... B65D 41/18

[52] U.S. Cl. ..... 220/306; 220/339; 220/359; 383/63

[58] Field of Search ..... 220/306, 359, 339; 383/61, 63

[56] References Cited

U.S. PATENT DOCUMENTS

| | | | |
|---|---|---|---|
| 3,181,583 | 5/1965 | Lingenfelter | 383/63 X |
| 3,676,159 | 7/1972 | Fallowfield | 383/63 X |
| 4,124,141 | 11/1978 | Armentrout et al. | 220/306 |
| 4,582,549 | 4/1986 | Ferrell | 383/63 X |
| 4,618,383 | 10/1986 | Herrington | 383/63 X |
| 4,655,862 | 4/1987 | Christoff et al. | 383/63 X |
| 4,741,789 | 5/1988 | Zieke et al. | 383/63 X |
| 4,782,951 | 11/1988 | Griesbach et al. | 383/63 X |
| 4,824,497 | 4/1989 | Tilman | 383/63 X |
| 4,836,401 | 6/1989 | Ingemann | 220/306 X |
| 4,896,775 | 1/1990 | Boeckmann et al. | 220/359 X |
| 4,906,310 | 3/1990 | Brodench et al. | 383/63 X |

*Primary Examiner*—Bryon P. Gehman

*Attorney, Agent, or Firm*—Alan Ruderman

[57] ABSTRACT

Reclosable packages for food products and methods for making the packages, each package having a semi-rigid base including a recess for containing the food and a thin film flexible lid. The base has an upper peripheral flange extending from an edge of the recess to an outer edge, an elongated groove being formed in all but a minor portion of the flange. A rib is positioned within the groove. The lid and rib are formed from a first thermoplastic material while the base is formed from a second thermoplastic material having a fusion seal inhibitor relative to the first material. During the process of forming the package the rib is fusion bonded to the lid and peelably sealed within the groove, the lid also being peelably sealable to the flange. Spaced apart recesses extending across the groove are formed in the flange to provide rigidity to the flange. The sealed package may be opened about the minor portion acting as a hinge by peeling the lid together with the rib from the base, and may be reclosed by reinserting the rib into the groove after only a portion of the food product has been used. The method includes either extruding rib forming material into the groove or directing a rod of preformed rib material into the groove and forcing the rod into the groove, in either case the material being in the groove prior to sealing the package.

14 Claims, 3 Drawing Sheets

RECLOSABLE PACKAGE AND A BASE PORTION OF THE PACKAGE

BACKGROUND OF THE INVENTION

This invention relates to reclosable packages and the method for making same, and more particularly to packages of food having a lid sealed to the package base which may be lifted from the base and folded about an edge thereof, and resealable about the lifted portion.

Various processed meats, cheeses and other food products are packaged and marketed in transparent flexible thermoplastic packages which have been evacuated and hermetically sealed to maintain the original freshness and texture. Once the seal of such packages are opened, if the contents are not then completely consumed, the balance of the contents must be refrigerated to prevent it from becoming stale within a short time. Repackaging of the remaining product has been the usual manner of preserving the contents, but the prior art relatively recently has developed packaging having resealing means once the package has been opened. Certain of these package resealing means are relatively complex to use properly and require extensive directions on the packages, while others can be destroyed during the original opening procedure due to the packaging material used.

The prior art describes numerous packaging developments developed toward a solution of certain of the aforesaid problems. For example, Griesbach et al U.S. Pat. No. 4,782,951 and Sanborn U.S. Pat. No. 4,437,293 disclose evacuated hermetically sealed packaging having interlocking closure strips which are used for reclosing the package after the original seal has been broken. In the former development the closure strip is outside of a peelable hermetic seal while in the latter the closure strip is inside of a hard or permanent heat seal. Lingenfelter U.S. Pat. No. 3,181,583, and Branson U.S. Pat. No. 4,787,755 show similar closures for a reclosable pouch or bag which is not initially evacuated. Boeckmann et al U.S. Pat. No. 4,896,775 has a cover sealed to a base and has interlockable closure strips about one edge. A rib fastener is integral with or bonded to the cover or lid, and a receiving groove is on a web having a flange bonded to a rim of the base with a frangible tear line in the web thereby forming a double portion. When a sealed tray is to be opened, the tear line is broken and the cover lifted by pulling on the flange of the web. Alternatively, the two portions of the fastener are manufactured separate and bonded to the cover and base. In Fallowfield U.S. Pat. No. 3,676,159 a package is described having a cover and a base, and includes interlocking ribs and grooves for resealing about the entire periphery. The lid and the base are formed by molding rigid polystyrene, the lid having a contour for nesting within a recess formed in the base. Other prior art located during a preliminary patentability search located a number of patents relating to various methods for making packages with reclosable fasteners and means for extruding interlocking profiles onto a film. Examples of United States Patents located include: U.S. Pat. No. 4,859,259 (Scheiber); U.S. Pat. No. 4,824,497 (Tilman); U.S. Pat. No. 4,906,310 (Broderick et al); U.S. Pat. No. 4,741,789 (Zieke et al); U.S. Pat. No. 4,655,862 (Christoff et al); U.S. Pat. No. 4,618,383 (Herrington); U.S. Pat. No. 4,582,549 (Ferrell); U.S. Pat. No. 4,240,241 (Sanborn); and U.S. Pat. No. 4,673,601 (Lamping et al) which discloses a composite film for resealing packages. Other art using resealable adhesive means include the following U.S. Patents: U.S. Pat. No. 4,786,190 (Van Arden et al); U.S. Pat. No. 3,307,773 (Kratzer et al); U.S. Pat. No. 3,310,225 (Hoblit et al); U.S. Pat. No. 4,415,087 (Clayton et al); U.S. Pat. No. 4,486,814 (Yanase); and U.S. Pat. No. 4,498,588 (Scott). A resealable package having an adhesive is also disclosed in applicant's copending patent application Ser. No. 07/379,913 filed on July 14, 1989, now U.S. Pat. No. 4,956,962.

It can therefore be seen that the prior art has endeavored to develop an inexpensive peelable resealable hermetically sealed package which is inexpensive to manufacture in long production runs and easily used by a consumer. It is highly desirable to have a formed base for receiving the food product, and a transparent flexible lid or cover that may be opened to break the seal, yet be readily reclosed by the consumer after a portion of the contents has been removed. It is one thing to have a reclosable package in the form of a bag or the like which is reclosable along one edge, but when the package has a formed base, difficulties are encountered when a relatively rigid base is used in conjunction with a flexible lid. Thus, in the aforesaid Fallowfield patent the lid and the base were both formed from relatively rigid material. In the aforesaid Boeckmann et al patent a complicated zipper-arrangement was proposed. One of the difficulties encountered in having a flexible film lid used with a zipper-type or rib and groove closure is that if the lid is formed with a portion of the closure member misalignment problems occur during production. For example, if, a rib is to be formed on the lid for insertion into a groove about the closure, the fact that the lid material is flexible and stretches results in a misalignment of the rib relative to the groove as the lid is attached to the base during production. This not only provides a seal that leaks but a failure to provide a closure when used by the consumer. This is especially significant when the rib and groove extend about substantial portions of the respective lid and base of the package as a result of the cumulative effect of the stretching.

SUMMARY OF THE INVENTION

Consequently, it is a primary object of the present invention to provide a resealable package having a semi-rigid base and a flexible lid peelably sealed to the base, the lid having a rib extending about a substantial portion thereof and the base having a groove for receiving the rib to permit the package to be reclosed readily, the lid being initially peelably sealed to the base about both sides of the rib and groove.

It is another object of the present invention to provide a method of producing a resealable package for food and the like having a flexible lid and semi-rigid base sealed together so as to be peeled apart, the resealing means including a rib on the lid receivable within the groove on the base.

It is a further object of the present invention to provide a method of producing a reclosable package for food and the like having a flexible lid and a semi-rigid base sealed together so as to be peeled apart readily, the resealing means including a rib on the lid receivable within a groove on the base, the method including the step of placing the rib into the groove and then fusion bonding the lid to the rib and non-fusion bonding the lid to the base.

It is a still further object of the present invention to provide a resealable package having a semi-rigid base and a flexible lid, the materials of the base and lid differing from each other so that the lid may be non-fusion bonded to the base to provide a peelable seal, the lid having a rib for cooperating with a groove in the base for reclosing after the package has been opened, the rib being formed from the same material as the lid and inserted into the groove prior to the lid being peelably sealed to the base and permanently sealed to the rib.

It is a yet still further object of the present invention to provide a semi-rigid base for a food container to which a flexible lid is to be sealed, the base having a peripheral flange at least a portion of which includes a groove, and a flexible rod disposed or formed within the groove, the material of the rod and the base differing so that the rod is not fusion sealed to the base when the lid, which is of the same material as the rod, is peelably sealed to the base and fusion sealed to the rod.

Accordingly, the present invention provides a resealable package for food products or the like, the package having a semi-rigid base within which the product is contained and a thin film flexible lid or cover. The base has a peripheral flange to which the lid is peelably sealed by a non-fusion bonded seal after the food has been inserted and after evacutation of air so that the package is hermetically sealed. The base, or at least that portion of the flange that contacts the lid, is a different material from that of the lid at least at the corresponding contact surface so that when the lid is sealed to the base by means of heat, a fusion seal inhibitor is provided. The lid is thus peelable from the base when desired. The base has a groove extending about a portion of the flange into which a flexible rod of the same material as the lid is positioned or formed prior to sealing the lid to the base. When the lid is non-fusion sealed to the base, the lid is fusion sealed to the rod and becomes integral therewith. When the lid is peeled from the base by the consumer, the rod is lifted with the lid and may be pushed back into the groove to reclose the package after removal of a portion of the contents. Because the rod is disposed in the groove of the base flange, and is not formed on the lid before the lid is sealed to the base, the stretching of the flexible film lid which occurs as the package is being formed, does not create misalignment problems between the lid and the base. The rod thus forms a rib on the lid only during the sealing portion of the process of forming the package and the difficulties of the prior art are avoided. The rib formed in this manner additionally is properly aligned with the groove when reclosing by the consumer is required.

In the preferred form of the invention the groove and rib are formed about all but a relatively minor portion of the package so that the flexible lid may be folded or rolled back about that portion of the package formed by the non-fusion bonding alone. Additionally, the non-fusion bonding of the lid to the flange at the location of the rod is adjacent both sides of the rod and rib formed thereby since it is preferable to heat seal the lid along the peripheral surface of the flange to preclude or minimize leakage prior to opening, and since the groove is substantially centrally disposed within the flange.

It is also preferred that the surface of the lid that contacts the flange, and the rod material, be formed from a synthetic polymer, while the surface of the flange that contacts the lid and the rod be formed from a similar material which has been modified or contaminated with a fusion seal inhibitor so that the two materials do not fusion bond together.

Another aspect of the invention is the provision of a plurality of ribs disposed in the flange transverse to the groove, the ribs being recessed within the groove and forming protuberances on the surface of the flange remote from the lid. The groove, for example, is formed in the flange while the base is molded in forming dies. Thus, the groove is recessed from one surface of the flange, e.g., the top, and is a protuberance on the other surface, e.g., the bottom. The plurality of ribs are formed at the same time as the groove and are protuberances on the bottom extending transverse to the groove. These ribs/protuberances provide increased rigidity to the flange and the groove so that the rib formed by the rod material may easily be inserted into the groove and not be readily released without pressure being exerted by the consumer.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
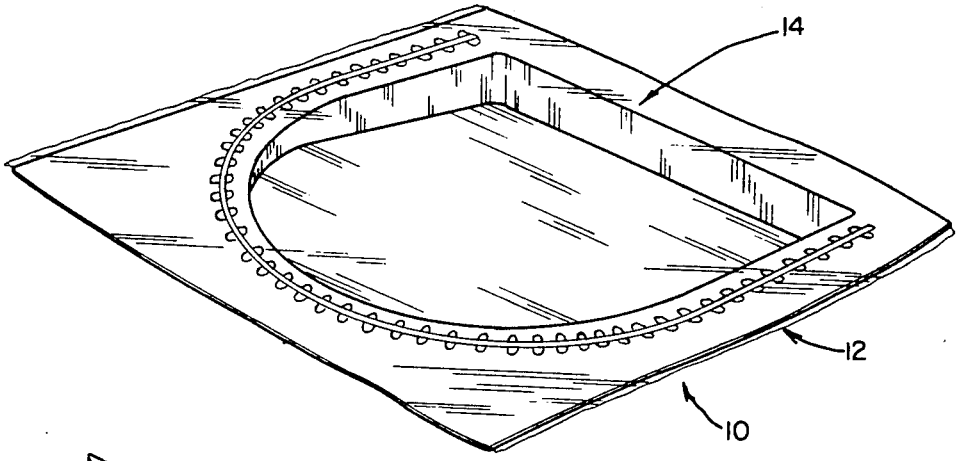
FIG. 1 is a perspective view of a preferred form of a sealed package constructed in accordance with the principles of the present invention.
Figure 2:
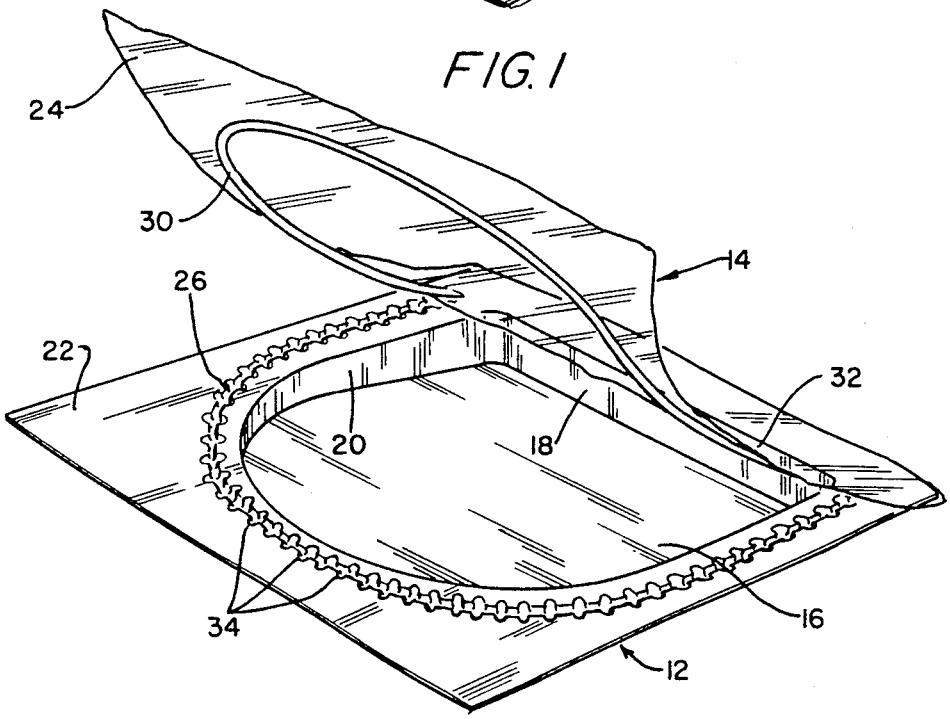
FIG. 2 is a view similar to FIG. 1, but with the lid being peelably released from the base about a substantial portion of the periphery and folded back about the remainder of the periphery of the base.

Referring to the drawings, particularly to FIGS. 1 and 2, a package constructed in accordance with the present invention is generally illustrated at 10, the package comprising a base portion 12 formed from forming plastic sheet film that can be formed into a semi-rigid shape, the film preferably comprising a plurality of plies or laminates of thermoplastic film material, and a second or lid portion 14, preferably transparent, which is formed from lidding stock which may also comprise a plurality of plies or laminates of thermoplastic material. Although the particular shape of the package is not critical, the preferred shape as illustrated, is rectangular in plan, but with the base having a food receiving cavity 16 with a linear wall 18 and another wall 20 having a linear portion and an arcuate portion. Both the base 12 and the lid portion 14 have respective peripheral flanges 22, 24. The upper surface of the flange 22 of the base 12 and the lower portion of the flange 24 of the lid 14 that contacts it must, according to the present invention, be materials which peelably seal together but do not fuse together. For example, in the preferred embodiment the base is formed from a laminate or coextrusion that comprises (a) a lower surface formed from a thermoplastic polymer sheet, such as a rubber modified acrylonitrile methyl acrylate copolymer, such a material being manufactured and sold by B.P. Chemicals, International of Cleveland, Ohio under the trademark BAREX, or alternatively a PVC film may be utilized, as can any thermoplastic material that has rigidity; (b) an inner surface, including the upper surface of the flange 22, comprising a low density polyethylene having a rubber based additive to preclude fusion bonding of the upper surface of the flange 22 with the lid, as hereinafter described; and (c) an adhesive such as a polyurethane adhesive between the laminates. The lid material is a flexible film and may be a laminate, or coextrusion, comprising (a) nylon on the outer or upper surface, preferably a biaxially oriented nylon coated on the inner surface with SARAN brand copolymer of polyvinylidene chloride manufactured and sold by Dow Chemical Company of Midland, Mich., or alternatively the coating may be an ethylene vinyl alcohol copolymer, the nylon providing strength and the coating providing a gas barrier; (b) a lower surface formed from a low density polyethylene, identified in the trade as a seal/peel material, and having an anti-fog agent; and (c) a polyurethene adhesive between the laminates. The rubber based additive to the inner surface of the base, or at least of the upper surface of the flange 22, permits the polyethylene surface of the lid to be bonded to it yet acts as a fusion seal inhibitor so that the lid will not be permanently fused to the flange but may be peeled therefrom when the package is opened. Other modifications to the polyethylene to provide a seal/peel may be by means of an ethylene-vinyl acetate copolymer-polystyrene-polyethylene blend. In this instance a fusion seal inhibitor is provided by the low cohesive strength of the film and the peel properties are the result of film failure on opening.

Formed in the central portion of the upper surface of the flange 22 is a groove 26 which is deeper than the thickness of the base including the flange and is recessed below the upper surface of the flange so that the groove projects as a protuberance 28 from the lower surface of the flange. The groove is formed during the process of molding the base in forming dies as hereinafter further described, the forming process itself being conventional. As hereinafter described, the groove during the process of the present invention receives a polyethylene rod, or the polyethylene may be extruded directly into the groove. During the sealing stage of the process heat is applied to hermetically seal the lower surface of the flange 24 of the lid to the upper surface of the flange 22 in a non-fusion bond while a fusion bond is provided between the polyethylene rod and the contacting polyethylene surface of the lid material. Also, since the rod material is polyethylene it is not fusion bonded into the groove 26. Thus, the lid is fusion bonded to the rod material in the groove but is non-fusion bonded to the upper surface of the lid both to the inside and the outside of the rod. A peelable seal is therefore formed between the lid material and the flange 22 on either side of the groove 26 and between the rod material and the surface of the groove. When the lid is peeled and lifted from the base, as illustrated in FIG. 2, the rod material which has been fused to the lid is peeled from the groove in the form of an elongated rib 30 as the lid is peeled from the surface of the flange 22. After a portion of the contents of the package have been removed, the lid may be reclosed on the flange 22 of the base merely by pushing the 30 back into the groove 26 so that a reclosable package is provided.

In the preferred form of the package, the groove does not extend about the entire flange. A small portion of the flange is not formed with the groove, e.g., in the preferred embodiment where the flange has a rectangular shape, one end portion 32, as illustrated in FIG. 2, does not include the groove, which is continuous about the remainder of the flange. Thus, the lid may be peeled and lifted from the major portion of the flange without disturbing the small non-groove containing portion which acts as a hinge about which the lid may be rolled, folded or lifted, and thereafter reclosed by the rib-in-groove arrangement provided in the remainder of the lid and flange respectively.

Figure 3:
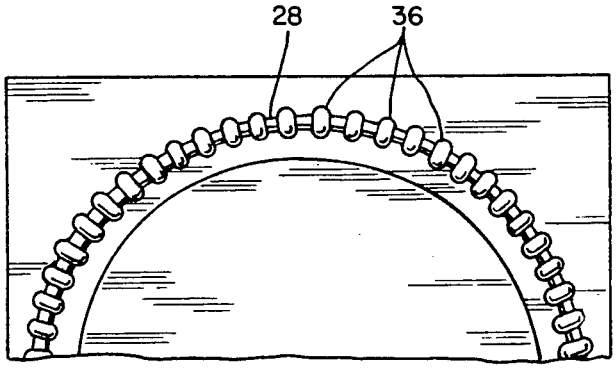
FIG. 3 is a fragmentary bottom plan view of the flange portion of the base of the package illustrated in FIGS. 1 and 2.
Figure 6:
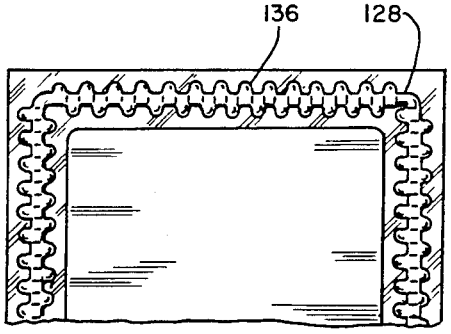
FIG. 6 is a fragmentary bottom plan view of the flange portion of the base of the package illustrated in FIGS. 3 and 4.

As illustrated in FIG. 1, 2 and 3 a multiplicity of small recesses 34 extend transversely to the groove 26, the recesses 34 being ribs or ridges 36 in the lower surface of the flange 22 so as to form a spine and ridge construction with the protuberance 28 resulting in the lower surface of the flange due to the formation of the elongated groove 26. Each recess 34 and ridge 36 may extend across the groove from one side to the other as illustrated, but may comprise recesses or ribs at one side offset from similar recesses on the other side if desired as illustrated in FIG. 6 in conjunction with the alternate embodiment hereinafter described. This spine and ridge construction provides rigidity to the flange and the groove 26 so that the rod formed rib 30 may be firmly pressed into the groove 26 when reclosing the package, and the rigidity also precludes the elongated rib 30 from inadvertently being released from the groove 26 after reclosing.

Figure 4:
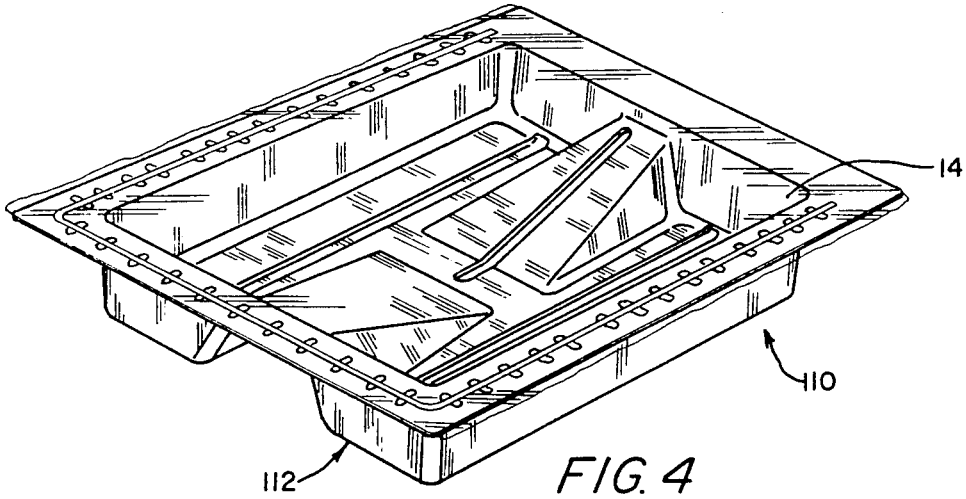
FIG. 4 is a view similar to FIG. 1 but illustrating an alternative form of a package constructed in accordance with the present invention.
Figure 5:
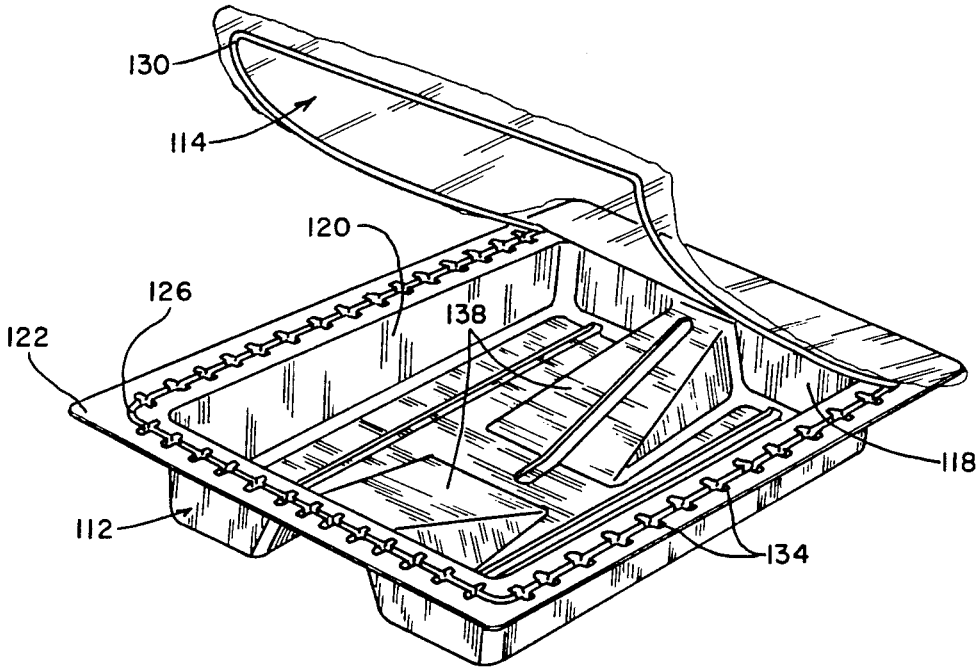
FIG. 5 is a view similar to FIG. 2, but of the package illustrated in FIG. 4.

An alternate form of the package 110 is illustrated in FIGS. 4, 5 and 6, the only difference between this form and that illustrated is the configuration of the food receiving cavity and the depth of the cavity. In the embodiment illustrated in FIGS. 1–3 the cavity has a depth that varies, decreasing from the end 32 toward the other end, i.e. the wall 20 is deeper adjacent the wall 18 than at the other end, while in FIGS. 4–6, the depth of the wall 118 and 120 are substantially the same and the cavity 116 is rectangular. Additionally, the base 112 includes a pair of partitions 138. In all other respects the package 110 and the formation thereof are the same as the package 10. Of course the groove 126 formed in the flange 122 has three straight portions as does the rib 130 extending from the lower surface of the lid 114. Recesses 134 transverse to the grooves 126 at the upper surface of the flange 122 of the base 112 may extend across the groove 126 as in the embodiment illustrated in FIGS. 1-3 or may be offset on opposite sides of the groove to form ridges 136 each of which extends partially across the protuberance 128 resulting at the bottom surface of the flange 122 due to the groove 126 in the upper surface.

Figure 7:
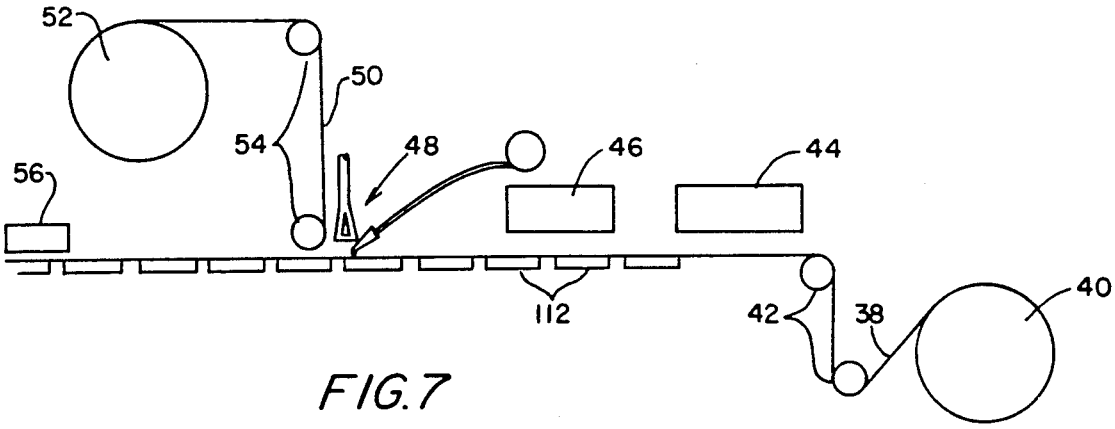
FIG. 7 is a schematic view of a portion of the method of the present invention for producing the packages of the present invention.
Figure 11:
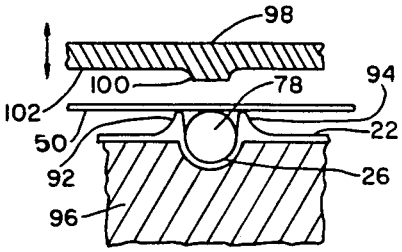
FIG. 11 is a cross sectional view through heating apparatus for sealing the lid to the base and fusing the lid to the rod of the package illustrated in FIGS. 1 and 4.
Figure 12:
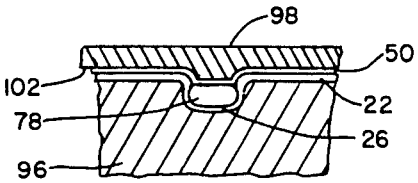
FIG. 12 is a view similar to FIG. 11 with the heating apparatus in the sealing position.

In the process of forming the package 10 or 110, as illustrated in FIG. 7, which is an overview of the preferred process for forming either package, the sheet of forming material or stock 38 for forming the base 12 or 112 is paid-out from a roll 40 about a number of guide and/or feed rollers generally indicated at 42 and fed to the forming station 44. The stock is heated at the forming station and formed into the desired shape of the base of the package by conventional means including the drawing of a vacuum and the application of compressed air to form the stock in conjunction with one or more forming dies. The groove 26, 126 and the transverse recesses 34, 134 of the respective package 10, 110 are formed together with the flange of the base at the forming station, the flange adjacent the groove being upset above and tapering toward the remainder of the flange as hereinafter described in conjunction with FIG. 11. The formed bases are thereafter fed to the product inserting station 46 where the food product is inserted into the base. The bases are then moved by conveyor to the rod insertion station 48 wherein the rod material is inserted into the groove either as a preformed rod guided and forced firmly into the groove, as hereinafter described, or extruded into the groove from a liquid state forced through a nozzle directed into the groove. Subsequent to the insertion of the rod material into the groove of the base, the bases move to a lid dispensing station where the sheet of covering stock 50 is paid-out from a roll 52 guided by guide and/or feed rollers generally indicated at 54. The bases with the lid material disposed thereon are thereafter fed to the sealing station 56 where air is evacuated, which may include the application of an inert gas into the bases, and where heat is applied by anvils in conventional manner to fusion bond the lid material to the rod material and to non-fusion bon or peelably seal the flange of the base to the corresponding overlaid surface of the lid material, thereby forming the flange of the lid while simultaneously peelably sealing the rod material within the groove of the flange of the base.

Figure 8:
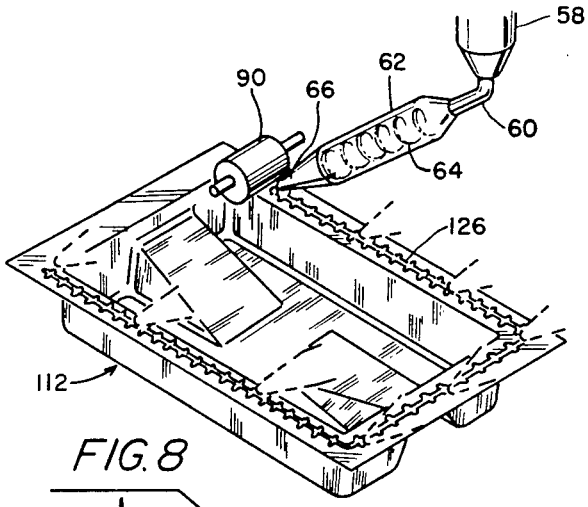
FIG. 8 is a diagrammatic view illustrating one form of apparatus for performing the step of inserting rod material into the groove in a formed base of the package during the method of the present invention.

As aforesaid, prior to the lid material being laid upon the upper surface of the flange of the base, the rod forming material is inserted into the groove in the flange of the base. This may be performed in a number of ways. The processes are identical in regard to the bases 12 and 112 except for those differences due to the different planar configurations of the grooves 26, 126, and are illustrated with respect to the bases 112 in FIGS. 8 through 10 for ease of presentation. The preferred manner of inserting the rod material, as illustrated in FIG. 8, is by extruding the material directly into the groove 126. Thus, rod forming material, i.e., polyethylene crystals or the like, are disposed and heated in a hopper 58 and transmitted through a conduit or the like 60 into a conventional extruder 62, the extruder having an extrusion screw 64 internally thereof which liquifies and forces the rod forming material through an extrusion nozzle 66. The extrusion nozzle is mounted over the base 112 and driven by conventional means in a path defined by the planar shape of the groove 126, i.e., a U-shape path, to force the liquified rod forming material into the groove 126, different positions of the extrusion nozzle being illustrated in phantom in FIG. 8. The rod forming material as it leaves the nozzle 66 begins to cool and solidifies shortly thereafter to form the rod.

Figure 9:
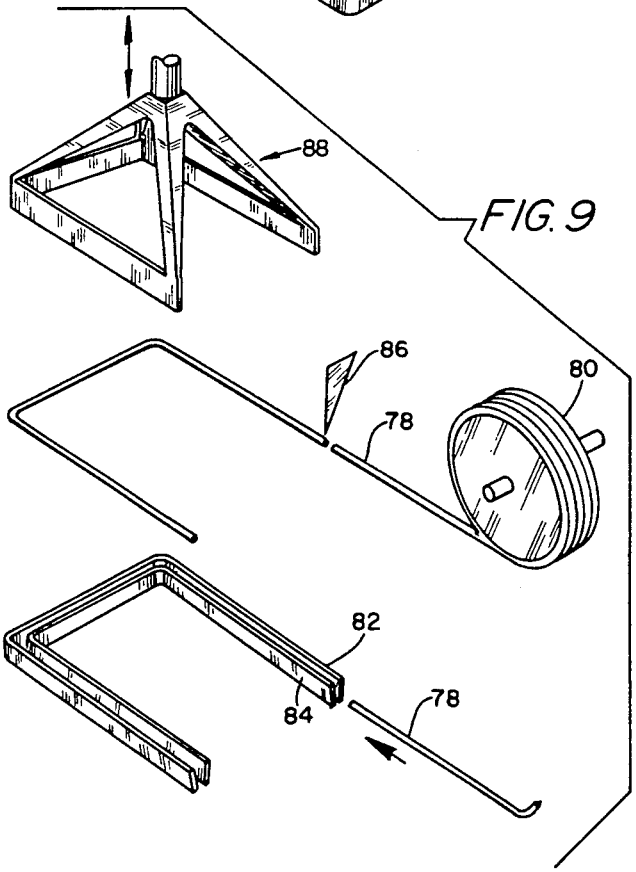
FIG. 9 is a diagrammatic exploded view of alternate apparatus for performing the rod insertion step in the method of the invention.
Figure 10:
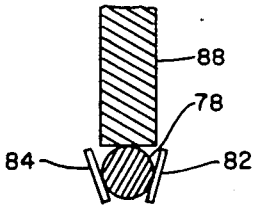
FIG. 10 is a fragmentary cross sectional view illustrating a portion of the method formed by the apparatus illustrated in FIG. 9.

Another method of inserting the rod into the grooves is illustrated in FIG. 9. Here, the rod material 78 is preformed and wound on a roll or spool 80. The preformed rod is then fed from the roll and driven between guide means, such as a pair of spaced apart guide clips 82, 84, each being formed in the planar shape of the groove 126 and disposed in overlaying relationship to the transverse sides of the grooves 126, the guide clips preferably being formed from spring steel or similar resilient material. The guide clips may be fixedly disposed on a fixture (not illustrated) or may be disposed on a movable member and moved downwardly when required. After a fixed amount of rod material has been dispensed between the guide clips, the rod material is cut and separated from the remainder of the material on the spool 80 by means of a knife 86 or similar cutting member. Disposed above the guide clips 82, 84 is a reciprocating ram 88 having the same planar shape as the groove and which is driven downwardly between the guide clips to force the rod into the groove 126, as illustrated in FIG. 10, after the rod material is cut.

A variation of the aforesaid methods for inserting the rod forming material into the grooves is by means of apparatus similar to that illustrated in FIG. 8, but which uses a preformed spool wound rod as illustrated in FIG. 9. In this method the rod is directed through directing means such as a nozzle similar to the nozzle 66 The nozzle is disposed slightly above the groove and travels in a path defined by the planar shape of the groove just as the extrusion nozzle 66. A roller 90, illustrated in FIG. 8, may be disposed rearwardly of the nozzle and driven in the same path, the roller being positioned so that its periphery will engage the rod and force the rod into the groove. Alternatively, guide clips 82, 84 and a ram 88 may be used in conjunction with the rod dispensing nozzle.

As aforesaid, when the bases 12, 112 are formed in the forming station 44, the flange 22 or the flange 122 as the case may be, is formed with upsets 92, 94 adjacent respective edges of the groove 26, or the groove 126, the upsets being raised above the remainder of the flange 22 and tapering back to the surface of the flange. This can readily be provided by an angular surface on the forming dyes adjacent the groove forming portions. The upsets extend above the remainder of the flange to at least the level of the top of the rod, and preferably slightly above that level, for reasons which will hereinafter become apparent During the sealing stage of forming the package, the base is positioned conventionally within a sealing dye housing 96 with the covering material 50 disposed on the top of the upsets 92, 94, and the rod 78, a heater plate 98 being disposed above the covering material. The heater plate 98 includes a downwardly projecting or protruding portion 100 which registers with the groove 26 and is adapted to engage the covering material 50 disposed on or slightly above the rod 78. Either the dye housing 96 or preferably the heater plate 98 is then actuated to move toward the other, so that the main portion 102 of the plate 98 engages the covering material on or above the flange 22 and the protruding portion 100 engages the covering material on the rod 78. The action of the plate 98 against the covering on the upsets 92 and 94 ensures that the covering is sealed about the entire rod, a fusion bond being formed between the covering 50 and the rod 78 to form the rib 30 on the cover, and a non-fusion peelable bond being formed between the covering and the remaining portion of the flange 22 including the upsets. It should be understood that the upsets are utilized since the groove 26 is substantially deeper beneath the top of the flange than the thickness of the material 38 forming the base, and likewise the diameter of the rod is larger than the base material thickness. The large groove and the rod forming the rib permits easy reclosing of the package after the package has been opened, while the upsets aid in providing a substantially leakage free original seal of the package.

A variation of the process for forming the packages 10, 110, is to first form the bases and insert the rod 78 as aforesaid, and to thereafter insert the food product. The covering stock and package sealing, of course, being carried in subsequent steps as described above. In this instance the bases and the rod disposed within the grooves may be formed and stored until needed. Consequently, the bases with the rod disposed within the grooves has utility as an intermediate product for subsequent use with a lid.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A reclosable sealed package for food products comprising a semi-rigid base formed from thermoplastic material having a recess for containing said products, said recess being surrounded by a peripheral flange at the top of said base extending from an inner edge in juxtaposition with a surface of said recess to an outer edge, an elongated groove formed intermediate said inner and outer edges in all but a minor portion of said flange, a rib disposed in said groove, and a flexible lid formed from a thermoplastic material peelably sealed to the top surface of said flange and fusion bonded to said rib, said rib and at least the surface of said lid facing said flange being formed from a first thermoplastic material, at least the surface of said flange facing said lid including said groove being formed from a second thermoplastic material having a fusion seal inhibitor relative to said first thermoplastic material such that said lid together with said rib may be peeled from all but said minor portion of said flange with said minor portion acting as a hinge for opening said package and affording access to products within said recess and permitting said lid to be reclosed upon said base when said rib is pushed back into said groove.

2. A reclosable package as recited in claim 1, wherein the depth of said groove and the thickness of said rib are greater than the thickness of said flange.

3. A reclosable package as recited in claim 2, including upsets in said flange adjacent said groove, and said lid is peelably sealed to said upsets.

4. A reclosable package as recited in claim 1, including a multiplicity of spaced apart recesses formed in said flange transversely to said groove.

5. A reclosable package as recited in claim 4, wherein each recess extends across said groove.

6. A reclosable package as recited in claim 3, including a multiplicity of spaced apart recesses formed in said flange transversely to said groove.

7. A reclosable package as recited in claim 6, wherein each recess extends across said groove.

8. A base for use in a reclosable sealed package for food products, said base comprising a semi-rigid formed thermoplastic material having a recess for containing said products, said recess being surrounded by a peripheral flange at the top of said base extending from an inner edge in juxtaposition with a surface of said recess to an outer edge, an elongated groove formed intermediate said inner and outer edges in at least all but a minor portion of said flange, a rib formed from a first thermoplastic material peelably sealed within said groove, at least the upper surface of said flange including said groove being formed from a second thermoplastic material having a fusion seal inhibitor relative to said first thermoplastic material such that said rib may be peeled from said groove.

9. A base as recited in claim 8, wherein the depth of said groove and the thickness of said rib are greater than the thickness of said flange.

10. A base as recited in claim 9, including upsets in said flange adjacent said groove.

11. A base as recited in claim 10, including a multiplicity of spaced apart recesses formed in said flange transversely to said groove.

12. A base as recited in claim 11, wherein each recess extends across said groove.

13. A base as recited in claim 8, including a multiplicity of spaced apart recesses formed in said flange transversely to said groove.

14. A base as recited in claim 13, wherein each recess extends across said groove.

* * * * *